US007024980B2

(12) United States Patent
Uryu et al.

(10) Patent No.: US 7,024,980 B2
(45) Date of Patent: Apr. 11, 2006

(54) HIGH-PRESSURE FUEL PUMP

(75) Inventors: Takuya Uryu, Tokyo (JP); Yoshihiko Onishi, Tokyo (JP)

(73) Assignee: Mitshbishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/443,850

(22) Filed: May 23, 2003

(65) Prior Publication Data

US 2004/0091377 A1 May 13, 2004

(30) Foreign Application Priority Data

Nov. 8, 2002 (JP) ..... 2002-325267

(51) Int. Cl.
*F01B 9/06* (2006.01)

(52) U.S. Cl. ..... 92/72; 92/129

(58) Field of Classification Search ..... 92/72, 92/129

See application file for complete search history.

(56) References Cited

U.S. PATENT DOCUMENTS

| | | | | |
|---|---|---|---|---|
| 2,079,821 A | * | 5/1937 | Scribner | 92/129 |
| 2,180,883 A | * | 11/1939 | Scott | 92/129 |
| 5,382,140 A | | 1/1995 | Eisenbacher et al. | |
| 5,415,533 A | * | 5/1995 | Egger et al. | 92/129 |

FOREIGN PATENT DOCUMENTS

| | | |
|---|---|---|
| DE | 198 27 926 A1 | 1/1999 |
| DE | 198 29 217 A1 | 1/1999 |
| DE | 199 43 160 A1 | 3/2000 |
| JP | 56-113104 U | 9/1981 |
| JP | 6-159192 A | 6/1994 |
| JP | 11-247741 A | 9/1999 |
| JP | 2000-145572 A | 5/2000 |
| JP | 2002-031017 A | 1/2002 |

* cited by examiner

*Primary Examiner*—F. Daniel Lopez
(74) *Attorney, Agent, or Firm*—Sughrue Mion, PLLC

(57) ABSTRACT

A high-pressure fuel pump of a simple construction is capable of distributing the position of contact between a tappet and a cam so as to improve durability of the tappet without causing seizure of a piston. A cylinder is arranged in a housing, and the piston is received in the cylinder for sliding reciprocation so that fuel is sucked into the cylinder and pressurized by the piston. The tappet is arranged inside one end of the housing for reciprocation, and contacts the cam, which rotates with a camshaft of an engine, so as transmit a driving force of the engine to the piston. A sleeve is arranged between the tappet and the housing, and clearance fitted to an outer peripheral surface of the tappet and an inner peripheral surface of the housing. The tappet is caused to rotate on its own axis by a frictional force generated between the cam and the tappet.

5 Claims, 7 Drawing Sheets

HIGH-PRESSURE FUEL PUMP

BACKGROUND OF THE INVENTION

1. Field of the Invention

The present invention relates to a high-pressure fuel pump for supplying a high-pressure fuel to an internal combustion engine.

2. Description of the Related Art

In a known high-pressure fuel pump, a tappet enclosed by a housing repeats vertical movements in alignment with a piston in accordance with the abutment or contact of the tappet with a cam while acting against the sliding resistance of an inner wall surface of the housing. The tappet does not basically rotate on its own axis, and hence the abutment of the tappet with the cam is always performed at the same locations or portions. As a result, wearing of the tappet progresses concentratedly only at those portions thereof at which the tappet is in line contact with the cam. In this case, there take place local wear of the tappet and resultant wear of the cam surface accompanying the tappet wear in accordance with a long period of use thereof, and if a prescribed amount of lift of the tappet provided by the cam profile is impaired, there might arise a situation where it becomes impossible for the piston to pressurize fuel to a desired pressure, thus leading to an inoperative condition of the high-pressure fuel pump.

In order to solve such an inconvenience, for instance, there has been known a method in which the outer peripheral surface of the tappet is formed into a special shape so that the sliding resistance between the tappet and the inner wall surface of the housing can be reduced, thereby facilitating accidental rotation of the tappet (a first patent document: Japanese patent application laid-open No. 2000-145572), or another method in which the cam profile is configured in such a manner that the abutment or contact position between the cam and the tappet is made apart from the axis of the tappet, thereby making it possible to obtain the self-rotating force of the tappet from a contact friction force generated during the rotation of the cam (a second patent document: Japanese patent application laid-open No. 2002-31017).

However, the high-pressure fuel pumps as constructed above have the following problems. That is, in the method described in the above-mentioned first patent document, it is difficult to form the outer peripheral surface of the tappet into a complicated configuration.

In addition, in the method described in the above-mentioned second patent document, a force acting on the piston in a diametral or radial direction thereof is generated due to eccentricity between the cam and the piston, thereby causing seizure of the piston.

SUMMARY OF THE INVENTION

The present invention is intended to obviate the problems as referred to above, and has for its object to provide a high-pressure fuel pump which is of a simple construction and which is capable of distributing the position of abutment or contact between a tappet and a cam so as to improve durability of the tappet without causing seizure of a piston.

Bearing the above object in mind, the present invention resides in a high-pressure fuel pump for supplying a high-pressure fuel to an internal combustion engine. The pump includes a housing, a cylinder arranged in the housing, and a piston received in the cylinder for reciprocating sliding movement for drawing fuel into the cylinder and pressurizing it. A tappet is arranged at one end portion of the housing for reciprocating motion therein and adapted to contact a cam, which rotates together with a camshaft of the internal combustion engine, so as to transmit a driving force of the internal combustion engine to the piston. A sleeve is arranged between the tappet and the housing, and clearance fitted to at least one of an outer peripheral surface of the tappet and an inner peripheral surface of the housing. The tappet is caused to rotate on its own axis under the action of a frictional force generated between the cam and the tappet.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings. The same or equivalent members and parts are identified by the same symbols throughout the following description of the various preferred embodiments and figures of the accompanying drawings.

Embodiment 1

Figure 1:
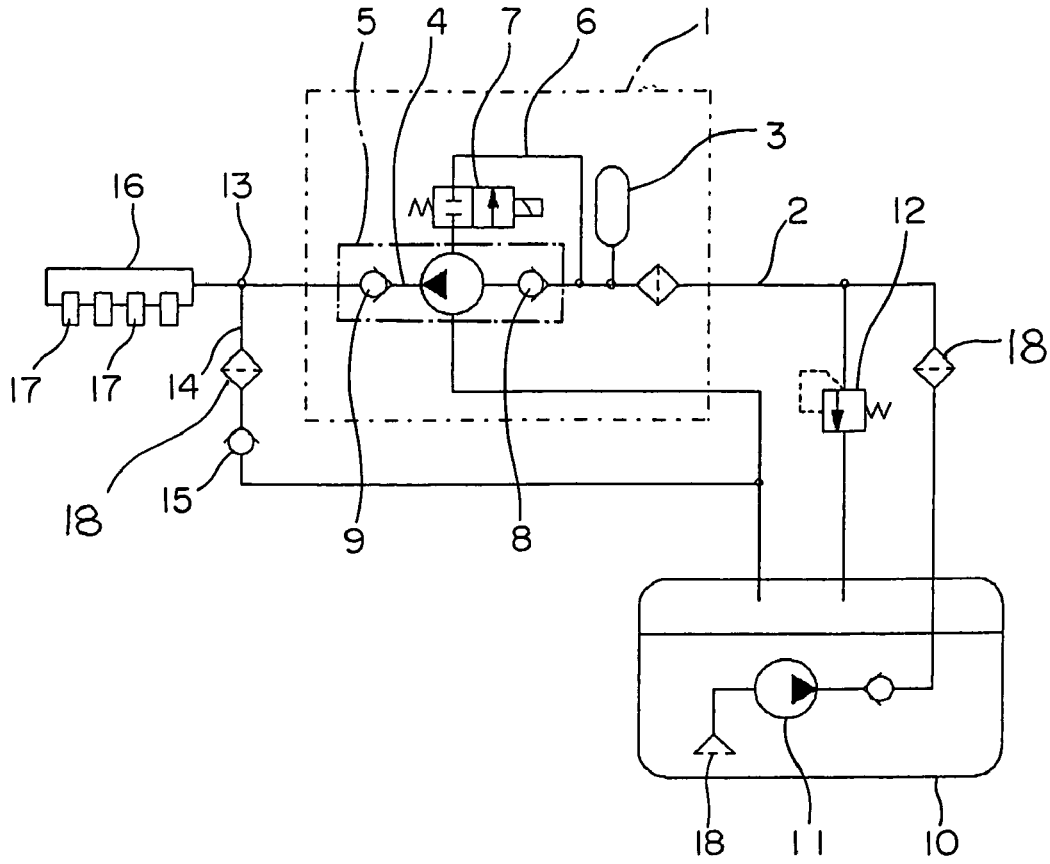
FIG. 1 is a circuit diagram of a high-pressure fuel supply system.

FIG. 1 shows a hydraulic circuit diagram including a high-pressure fuel supply system 1.

The high-pressure fuel supply system 1 includes: a low-pressure damper 3 arranged on a low-pressure fuel suction passage 2 for absorbing the pulsation of a low-pressure fuel; a high-pressure fuel pump 5 for pressurizing the low-pressure fuel from the low-pressure damper 3 to discharge it to a high-pressure fuel discharge passage 4; a relief passage 6 connecting between a suction side of the high-pressure fuel pump 5 and a pressurization chamber; and an electromagnetic valve 7 arranged on the relief passage 6 and being operated to open for adjusting the amount of fuel discharged from the high-pressure fuel pump 5. The high-pressure fuel pump 5 has a suction valve 8 and a discharge valve 9.

In the neighborhood of the high-pressure fuel supply system 1, there are provided a fuel tank 10, a low-pressure fuel pump 11 arranged in the fuel tank 10, a low-pressure regulator 12 branched from the low-pressure fuel suction passage 2 for regulating the low-pressure fuel at a constant pressure, a relief valve 15 arranged on a drain pipe 14 branched from the high-pressure fuel discharge passage 4 at a branch portion 13, a delivery pipe 16 connected with the high-pressure fuel discharge passage 4, a fuel injection valve 17 connected with the delivery pipe 16, and a filter 18 connected with the low-pressure fuel pump 11.

Figure 2:
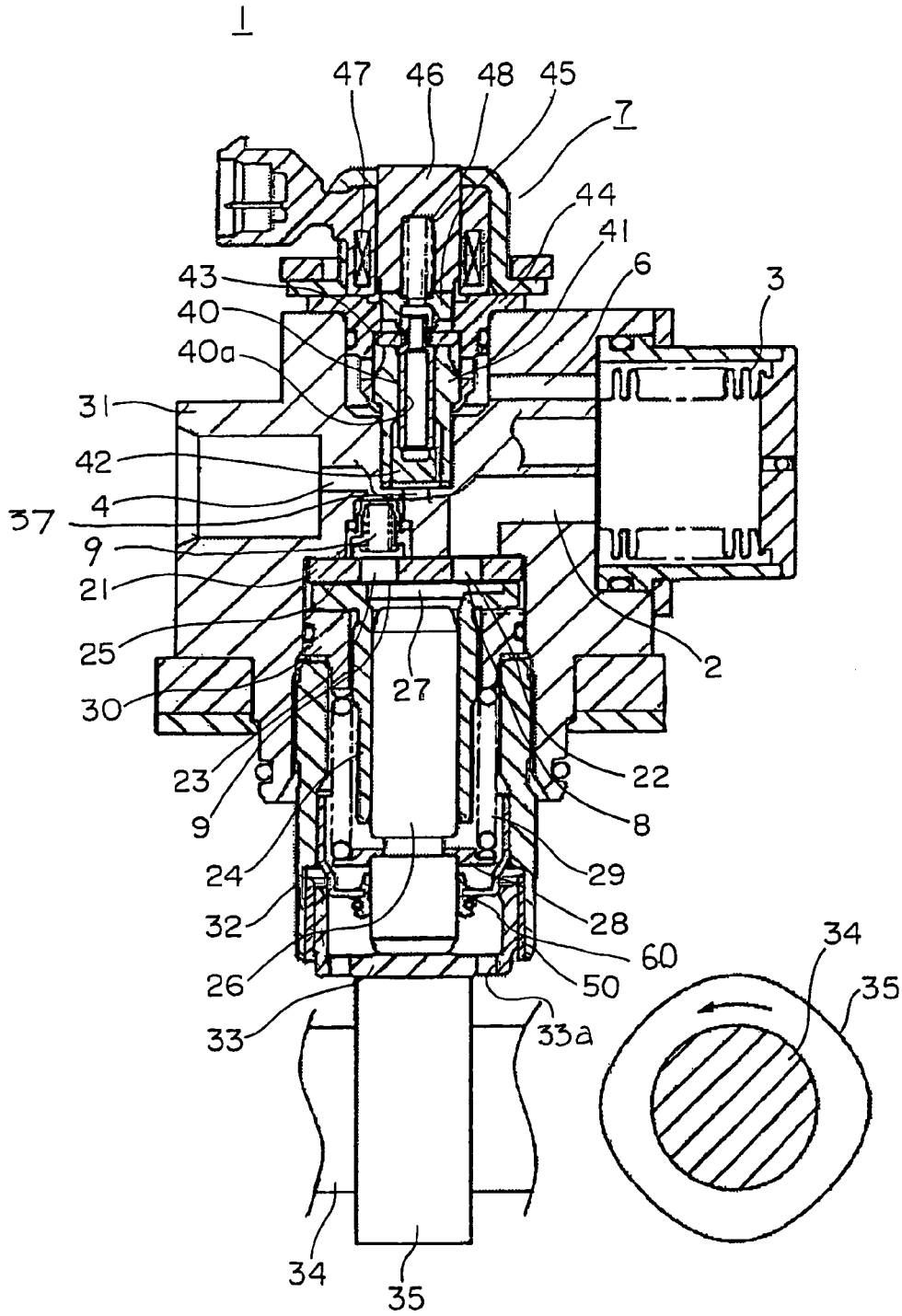
FIG. 2 is a cross sectional view of a high-pressure fuel supply system into which a high-pressure fuel pump according to the first embodiment of the present invention is incorporated.

FIG. 2 is a cross sectional view of the high-pressure fuel supply system 1 shown in FIG. 1.

The high-pressure fuel pump 5 of the high-pressure fuel supply system 1 includes: a plate 21 having a fuel suction port 22 connected with the low-pressure fuel suction passage 2 and a fuel discharge port 23 connected with the high-pressure fuel discharge passage 4; a cylinder 24 of a cylindrical shape; a valve disc 25 having the suction valve 8 and arranged between an upper end face of the cylinder 24 and the plate 21; the discharge valve 9 arranged on the high-pressure fuel discharge passage 4; a piston 26 slidably received in the cylinder 24 to define a fuel pressurization chamber 27 in cooperation with the cylinder 24 for pressurizing the fuel that flows into the fuel pressurization chamber 27; and a spring 29 arranged under compression between a receiving portion 28 and a bracket 30 for urging the piston 26 in a direction to enlarge the volume of the fuel pressurization chamber 27.

In addition, the high-pressure fuel pump 5 includes: a casing 31 having the low-pressure fuel suction passage 2 and the high-pressure fuel discharge passage 4; a housing 32 fixedly attached to the casing 31; a tappet 33 arranged in contact with a cam 35 that rotates with a camshaft 34 of an internal combustion engine so as to transmit the driving force of the internal combustion engine to the piston 26, the tappet 33 being reciprocatable in one end portion of the housing 32; a cylindrical sleeve 50 arranged between the tappet 33 made of cast iron steel and the housing 32; and an oil seal 60 for separating fuel and lubricating oil from each other. Here, note that the tappet 33 has a plurality of holes 33*a* formed through the bottom thereof at equal intervals in a circumferential direction for passage of the lubricating oil into and from the interior of the tappet 33.

The electromagnetic valve 7 of the high-pressure fuel supply system 1 includes: a plunger 40 having a fuel passage 40*a* formed therein along the axis thereof; a body 41 which is fitted in the casing 31 and a housing 44 and in which the plunger 40 is slidably received; a valve seat 42 arranged in pressure contact with an end of the plunger 40 and welded to the body 41; a stopper 43 of a C-shaped planar cross sectional configuration fixedly mounted on the housing 44 for limiting the amount of lift of the plunger 40 upon opening thereof; an armature 45 made of a magnetic material and welded to the plunger 40, a core 46 arranged in opposition to the armature 45; a solenoid 47 wound around the core 46; and a spring 48 arranged under compression inside the core 46 for urging the plunger 40 in a direction toward the valve seat 42 through the armature 45.

Figure 3:
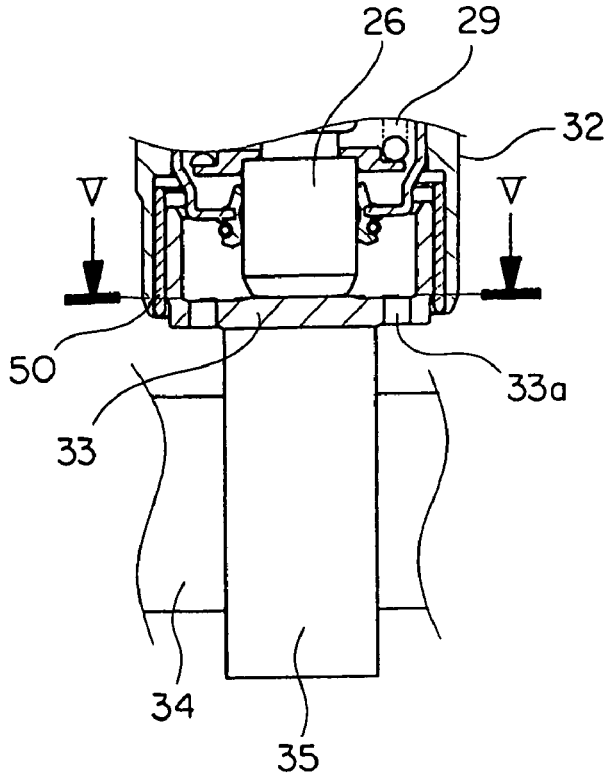
FIG. 3 is an enlarged view of essential portions of the high-pressure fuel supply system as shown in FIG. 2.
Figure 4:
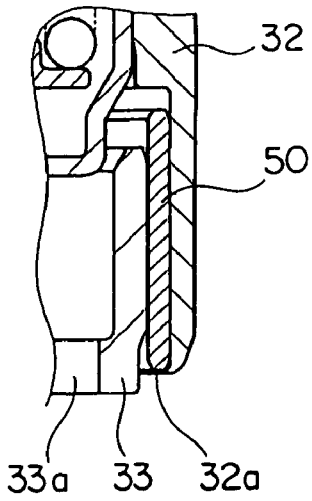
FIG. 4 is an enlarged view of essential portions of the high-pressure fuel supply system as shown in FIG. 3
Figure 5:
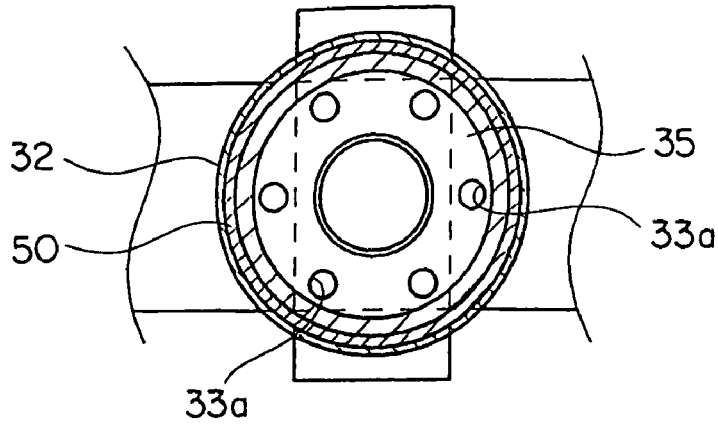
FIG. 5 is a cross sectional view taken along line V—V of FIG. 3.

FIG. 3 is an enlarged view of essential portions of the high-pressure fuel supply system 1 shown in FIG. 2. FIG. 4 is an enlarged view of essential portions of the high-pressure fuel supply system 1 shown in FIG. 3. FIG. 5 is a cross sectional view taken along line V—V of FIG. 3.

The sleeve 50 is clearance fitted to the outer peripheral surface of the tappet 33 and the inner peripheral surface of the housing 32. The sleeve 50 of the cylindrical shape has its inner and outer peripheral surfaces formed of stainless steel which has been subjected to a low friction treatment in the form of a grinding treatment. Note that alloy tool steel may be used instead of stainless steel.

An introduction space for the sleeve 50 is formed by enlarging the inside diameter of the housing 32 and/or reducing the outside diameter of the tappet 33. After the sleeve 50 is introduced into the introduction space, it is fitted into the interior of the space by bending a tip end 32*a* of the housing 32. The tip end 32*a* of the housing 32 also has the function of preventing the tappet 33 from dropping out therefrom.

With the high-pressure fuel supply system 1 as constructed above, the piston 26 is caused to reciprocate through the intermediary of the tappet 33 in accordance with the rotation of the cam 35 fixedly attached to the camshaft 34 of the internal combustion engine.

When the piston 26 descends (i.e., on the fuel suction stroke), the volume of the fuel pressurization chamber 27 increases to reduce the pressure therein. As a result, the suction valve 8 is opened so that the fuel in the low-pressure fuel supply passage 2 flows into the fuel pressurization chamber 27 through the fuel suction port 22.

When the piston 26 ascends (i.e., on the fuel discharge stroke), the pressure in the fuel pressurization chamber 27 increases to open the discharge valve 9 so that the fuel in the fuel pressurization chamber 27 is supplied to the delivery pipe 16 through the fuel discharge port 23 and the high-pressure fuel discharge passage 4. Thereafter, the fuel is supplied to the fuel injection valve 17 which serves to inject the fuel to respective cylinders (not shown) of the engine.

In addition, if the solenoid 47 is energized and excited, it generates attraction between the armature 45 and the core 46, whereby the plunger 40 is caused to move away from the valve seat 42 against the resilient force of the spring 48 until it comes into abutment with the stopper 43, thus opening the electromagnetic valve 7. As a result, the fuel pressurization chamber 27 is placed into communication with the relief passage 6 through the fuel passage 40*a* in the plunger 40 and a communication port 37, so that the pressure in the fuel pressurization chamber 27 is decreased. Consequently, the discharge valve 9 is closed to stop the supply of the high-pressure fuel to the fuel injection valve 17, and at the same time the fuel flows into the relief passage 6.

On the other hand, when the solenoid 47 is deenergized, the magnetic attraction between the armature 45 and the core 46 becomes zero so that the plunger 40 is placed in pressure contact with the valve seat 42 under the action of the resilient force of the spring 48, thereby closing the electromagnetic valve 7 and hence the relief passage 6.

Thereafter, when the piston 26 ascends, the fuel in the fuel pressurization chamber 27 is supplied to the delivery pipe 16 through the fuel discharge port 23 and the high-pressure fuel discharge passage 4, as described above.

Incidentally, in this embodiment, there are formed small spaces between the inner peripheral surface of the sleeve 50 and the outer peripheral surface of the tappet 33 and between the outer peripheral surface of the sleeve 50 and the inner peripheral surface of the housing 32, respectively, and hence the tappet 33 can rotate on its own axis, and at the same time, even if relative circumferential displacement of the tappet 33 with respect to one surface of the sleeve 50 becomes impossible by some causes, the tappet 33 is able to rotate as long as relative circumferential displacement of the tappet 33 with respect to the other surface of the sleeve 50 is possible.

Thus, it becomes easy for the tappet 33 to rotate on its own axis, so that the position at which the tappet 33 abuts or contacts the cam 35 always changes on the surface of the tappet 50. Therefore, the load is not concentrated on a specific portion or portions of the tappet 33, thus making it possible to provide a state of uniform load sharing over time on the surface of the tappet 50. As a result, the durability of the tappet 50 can be improved.

Moreover, the tappet 33 of this embodiment can be used under higher stress in comparison with the conventional tappet under the condition that the period of service life is the same between the tappet 33 of the first embodiment and a conventional tappet which repeats vertical movements in accordance with the abutment or contact thereof with the cam while resisting the sliding resistance of the inner wall surface of the housing. Thus, it is possible to increase the hydraulic pressure of the high-pressure fuel pump.

Furthermore, since the rotation of the tappet 33 on its own axis becomes easy, the dissipation or loss of torque at the sliding portions between the tappet 33 and the housing 32 and at the contact sliding portions between the tappet 33 and the cam 35 can be reduced, thus making it possible to decrease the required driving torque of the high-pressure fuel supply system.

Embodiment 2

Figure 6:
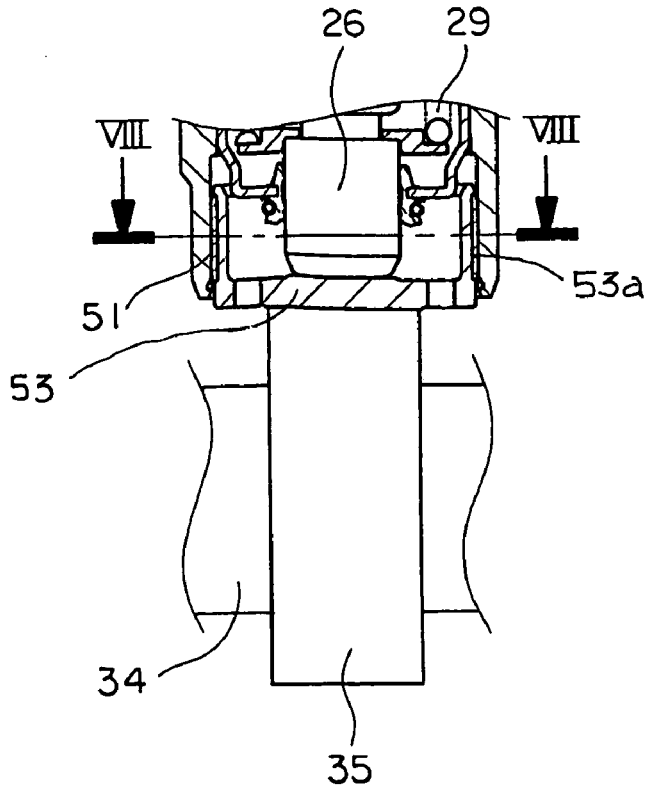
FIG. 6 is an enlarged view of essential portions of a high-pressure fuel pump according to a second embodiment of the present invention.
Figure 7:
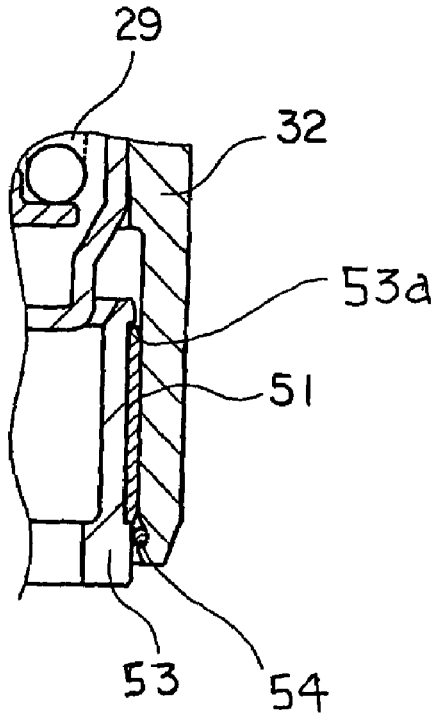
FIG. 7 is an enlarged view of essential portions of the high-pressure fuel pump as shown in FIG. 6.
Figure 8:
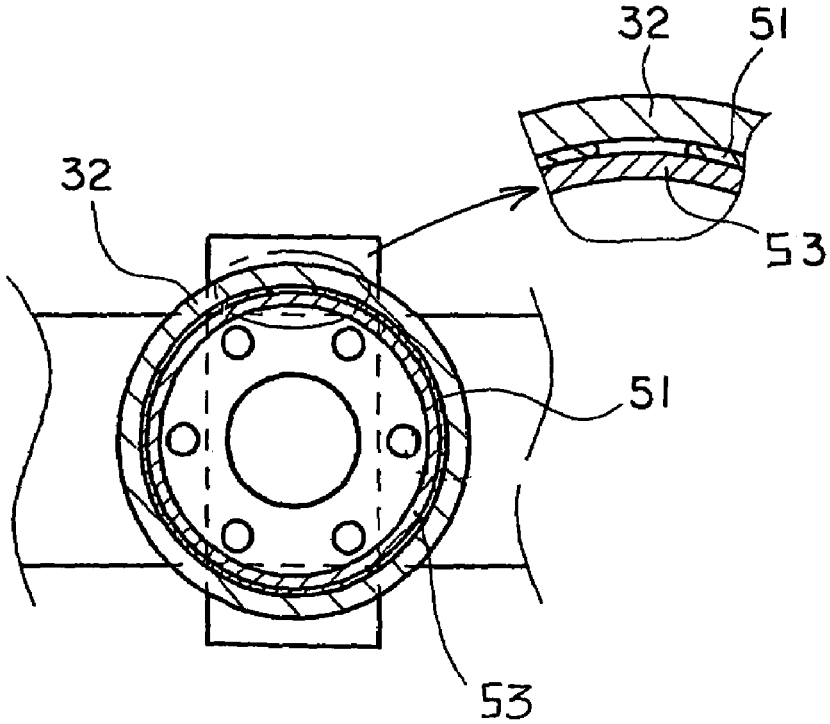
FIG. 8 is a cross sectional view taken along line VIII—VIII of FIG. 6.

FIG. 6 is a cross sectional view of a high-pressure fuel pump according to a second embodiment of the present invention. FIG. 7 is an enlarged view of essential portions of the high-pressure fuel pump shown in FIG. 6. FIG. 8 is a cross sectional view taken along line VIII—VIII of FIG. 6.

This second embodiment is different from the above-mentioned first embodiment in the followings. That is, a sleeve 51 is of a flexibly deformable C-shaped configuration; an axially wide groove 53*a* is formed on the outer peripheral surface of a tappet 53; and a ring 54 is arranged between an end of a housing 32 and the tappet 53 for preventing the sleeve 51 and the tappet 53 from dropping out from the housing 32.

After the sleeve 51 is inserted onto the tappet 53 in the axial direction thereof, it is engaged into the groove 53*a* formed on the outer peripheral surface of the tappet 53 by slightly deforming the sleeve 51 in a direction to decrease its radius of curvature at the location of the groove 53*a*.

In the high-pressure fuel pump of this embodiment, it is possible to obtain sliding surfaces of low friction with respect to the housing 32 in an easy manner as compared with the one as described in the above-mentioned first patent document in which the outer peripheral surface of a tappet is subjected to complicated machining or processing.

Embodiment 3

Figure 9:
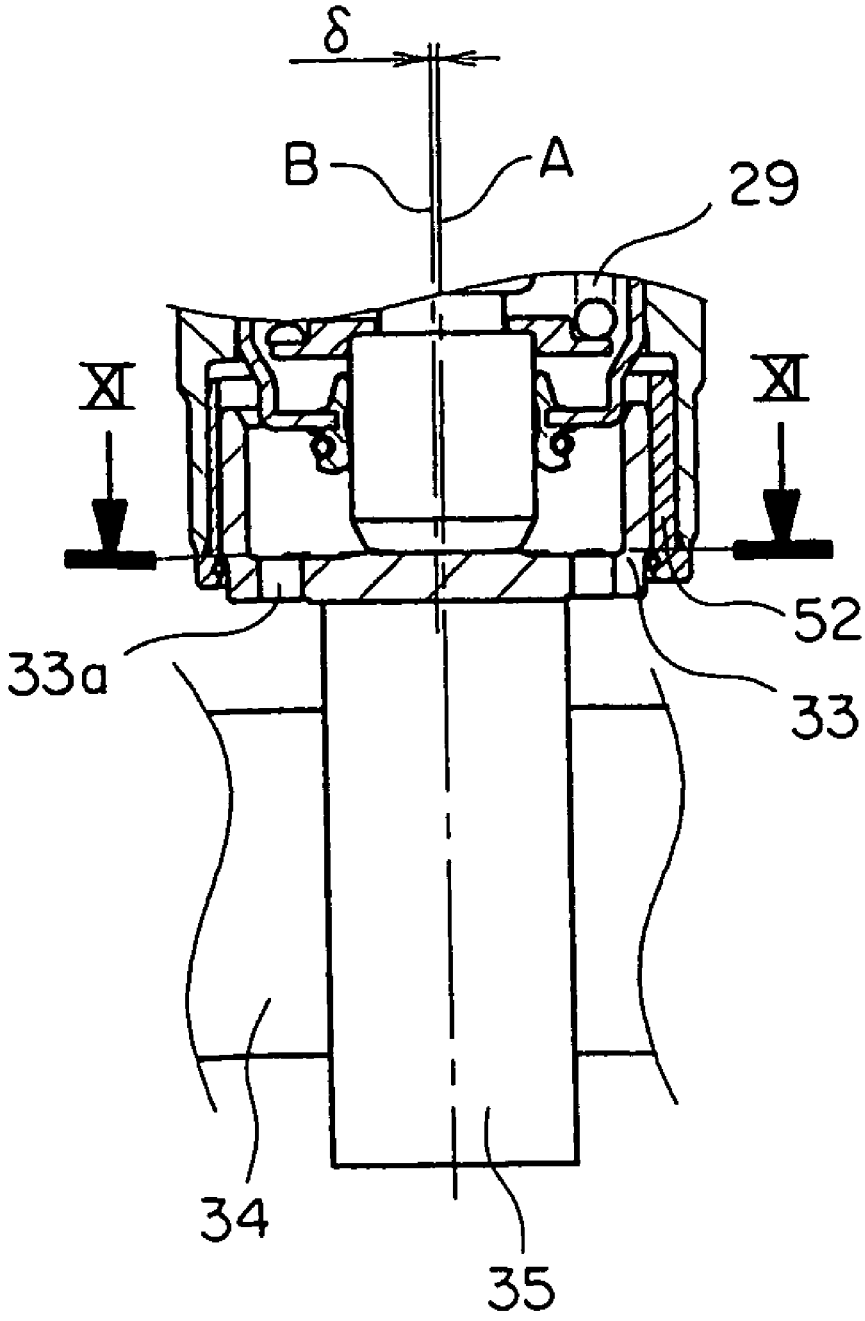
FIG. 9 is an enlarged view of essential portions of a high-pressure fuel pump according to a third embodiment of the present invention.
Figure 10:
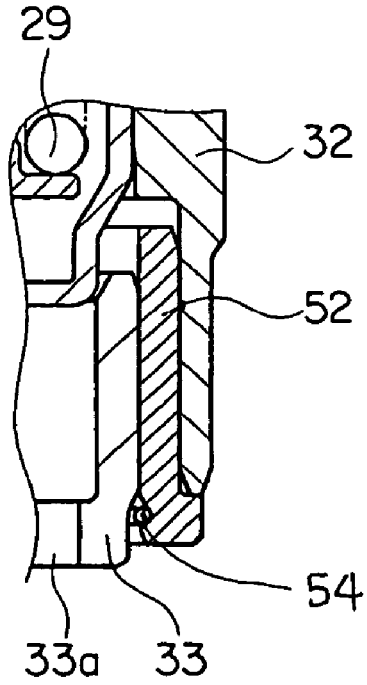
FIG. 10 is an enlarged view of essential portions of the high-pressure fuel pump as shown in FIG. 9.
Figure 11:
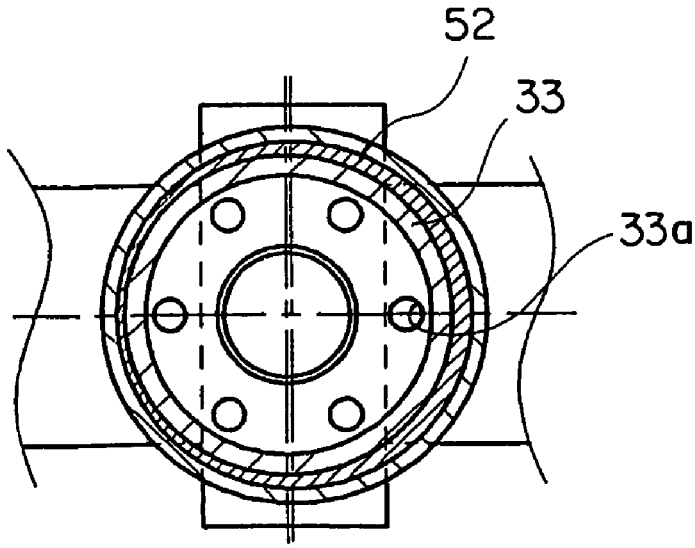
FIG. 11 is a cross sectional view taken along line XI—XI of FIG. 9.

FIG. 9 is a cross sectional view of a high-pressure fuel pump according to a third embodiment of the present invention. FIG. 10 is an enlarged view of essential portions of the high-pressure fuel pump as shown in FIG. 9. FIG. 11 is a cross sectional view taken along line XI—XI of FIG. 9.

In this third embodiment, the central point of contact of a cam 35, which is in contact with a tappet 33, is on the central axis A of a piston 26, and the central axis B of the tappet 33 is apart a distance δfrom the central axis A of the piston 26. A sleeve 52 is constructed in a such a manner that the thickness of the sleeve 52 varies gradually along a circumferential direction thereof, as a result of which the central point of the outer diameter of the sleeve 52 does not coincide with the central point of the inner diameter thereof.

According to this third embodiment, the central point of contact of the cam 35 is arranged apart the distance 6 from the central axis B of the tappet 33, so that a contact friction force, which is generated by the rotation of the cam 35 and acts on the tappet 33, contributes as a rotational force for causing the tappet 33 to rotate about the central axis B thereof. Since, however, the central point of contact of the cam 35 lies on the central axis A of the piston 26, there takes place no load that acts on the piston 26 in a diametral or radial direction thereof to cause seizure of the piston 26.

In the above-mentioned respective embodiments, each of the sleeves 50, 51 and 52 is arranged between the tappet 33 and the housing 32, and is clearance fitted to both of the outer peripheral surface of the tappet 33 and the inner peripheral surface of the housing 32, a clearance may be provided with respect to either one alone of both of these outer and inner peripheral surfaces.

While the invention has been described in terms of preferred embodiments, those skilled in the art will recognize that the invention can be practiced with modifications within the spirit and scope of the appended claims.

What is claimed is:

1. A high-pressure fuel pump for supplying a high-pressure fuel to an internal combustion engine, said pump comprising:

a housing;

a cylinder arranged in said housing;

a piston received in said cylinder for reciprocating sliding movement for drawing fuel into said cylinder and pressurizing it;

a tappet arranged at one end portion of said housing for reciprocating motion therein and adapted to contact a cam, which rotates together with a camshaft of said internal combustion engine, so as to transmit a driving force of said internal combustion engine to said piston; and a sleeve arranged between said tappet and said housing and clearance fitted relative to at least one of an outer peripheral surface of said tappet and an inner peripheral surface of said housing;

wherein said tappet is caused to rotate on its own axis under the action of a frictional force generated between said cam and said tappet, and wherein said axis around which said tappet rotates extends in the same direction as that of the reciprocating sliding movement of said piston, wherein a central point of contact of said cam that is in contact with said tappet lies on a central axis of said piston, and a central axis of said tappet is apart from the central axis of said piston.

2. The high-pressure fuel pump as set forth in claim 1, wherein said sleeve is constructed in such a manner that the thickness thereof varies gradually in a circumferential direction of said sleeve.

3. The high-pressure fuel pump as set forth in claim 1, wherein said sleeve has a surface which is subjected to a low friction treatment.

4. The high-pressure fuel pump as set forth in claim 1, wherein said clearance fit is comprised of a space between an inner peripheral surface of said sleeve and an outer peripheral surface of said tappet, as well as a space between an outer peripheral surface of said sleeve and an inner peripheral surface of said housing.

5. A high-pressure fuel pump, for supplying a high-pressure fuel to an internal combustion engine, said pump comprising:

a housing;

a cylinder arranged in said housing;

a piston received in said cylinder for reciprocating sliding movement for drawing fuel into said cylinder and pressurizing it;

a tappet arranged at one end portion of said housing for reciprocating motion therein and adapted to contact a cam, which rotates together with a camshaft of said internal combustion engine, so as to transmit a driving force of said internal combustion engine to said piston; and a sleeve arranged between said tappet and said housing and clearance fitted relative to at least one of an outer peripheral surface of said tappet and an inner peripheral surface of said housing;

wherein said tappet is caused to rotate on its own axis under the action of a frictional force generated between said cam and said tappet, and wherein said axis around which said tappet rotates extends in the same direction as that of the reciprocating sliding movement of said piston, wherein a wide groove extending in a circumferential direction of said tappet is formed on the outer peripheral surface of said tappet, and said sleeve of a C-shaped configuration is fitted into said groove.

* * * * *